US011730223B2

(12) United States Patent
Pomering

(10) Patent No.: US 11,730,223 B2
(45) Date of Patent: Aug. 22, 2023

(54) HELMET

(71) Applicant: MIPS AB, Täby (SE)

(72) Inventor: Amy Louise Pomering, Täby (SE)

(73) Assignee: MIPS AB

( * ) Notice: Subject to any disclaimer, the term of this patent is extended or adjusted under 35 U.S.C. 154(b) by 228 days.

(21) Appl. No.: 17/277,622

(22) PCT Filed: Sep. 19, 2019

(86) PCT No.: PCT/EP2019/075242
§ 371 (c)(1),
(2) Date: Mar. 18, 2021

(87) PCT Pub. No.: WO2020/058446
PCT Pub. Date: Mar. 26, 2020

(65) Prior Publication Data

US 2022/0022586 A1 Jan. 27, 2022

(30) Foreign Application Priority Data

Sep. 20, 2018 (GB) ..... 1815332
Jul. 11, 2019 (GB) ..... 1909979

(51) Int. Cl.
*A42B 3/06* (2006.01)
*A42B 3/04* (2006.01)

(52) U.S. Cl.
CPC ..... *A42B 3/064* (2013.01); *A42B 3/0406* (2013.01)

(58) Field of Classification Search
CPC ..... A42B 3/064; A42B 3/0406
See application file for complete search history.

(56) References Cited

U.S. PATENT DOCUMENTS 8,863,319 B2 * 10/2014 Knight ..... A42B 3/14 2/411
9,095,179 B2 * 8/2015 Kwan ..... A42B 3/063
2002/0197107 A1 12/2002 Granata
2015/0223547 A1 * 8/2015 Wibby ..... A42B 3/064 2/414
2016/0138626 A1 5/2016 Van Niekerk et al.
(Continued)

FOREIGN PATENT DOCUMENTS

CN 108294394 A 7/2018
EP 3481244 A1 5/2019
(Continued)

*Primary Examiner* — Tajash D Patel
(74) *Attorney, Agent, or Firm* — Perkins Coie LLP

(57) ABSTRACT

A helmet comprising: inner and outer shells configured to slide relative to each other; and a connector connecting the inner and outer shells so as to allow the inner and the outer shells to slide relative to each other, the connector comprising: an attachment part attached to one of the inner shell and the outer shell; wherein: the attachment part comprises one or more protrusions and the inner or outer shell attached to the attachment part comprises one or more channels into which the protrusions extend, the protrusions and channels are configured such that the protrusions can move within the channels in an extension direction of the protrusions, during sliding of the inner and outer shells relative to each other, and the protrusions comprise an abutment member configured to abut an abutment portion of the channel to prevent the protrusion leaving the channel.

19 Claims, 14 Drawing Sheets

(56) References Cited

U.S. PATENT DOCUMENTS

| | | | |
|---|---|---|---|
| 2017/0013907 | A1 | 1/2017 | Salmini et al. |
| 2017/0172242 | A1 | 6/2017 | Leatt et al. |

FOREIGN PATENT DOCUMENTS

| | | | | |
|---|---|---|---|---|
| FR | 2861439 | A1 | 4/2005 | |
| WO | 0145526 | A1 | 6/2001 | |
| WO | 2011139224 | A1 | 11/2011 | |
| WO | 2015177747 | A1 | 11/2015 | |
| WO | 2017148958 | A1 | 9/2017 | |
| WO | WO-2018108940 | A1 * | 6/2018 | ..... A42B 3/064 |
| WO | 2018177791 | A1 | 10/2018 | |

* cited by examiner

HELMET

RELATED APPLICATIONS

This application is a 35 USC § 371 National Stage application of International Application No. PCT/EP2019/075242, entitled "HELMET," filed on Sep. 19, 2019, which claims the benefit of United Kingdom Patent Application Nos. 1815332.0, filed on Sep. 20, 2018 and 1909979.5, filed on Jul. 11, 2019, the disclosures of which applications are incorporated herein by reference in their entireties.

The present invention relates to helmets. In particular, the invention relates to helmets in which an inner shell and an outer shell are able to slide relative to each other in response to an impact, and the connectors between those layers.

Helmets are known for use in various activities. These activities include combat and industrial purposes, such as protective helmets for soldiers and hard-hats or helmets used by builders, mine-workers, or operators of industrial machinery for example. Helmets are also common in sporting activities. For example, protective helmets are used in ice hockey, cycling, motorcycling, motor-car racing, skiing, snow-boarding, skating, skateboarding, equestrian activities, American football, baseball, rugby, cricket, lacrosse, climbing, airsoft and paintballing.

Helmets can be of fixed size or adjustable, to fit different sizes and shapes of head. In some types of helmet, e.g. commonly in ice-hockey helmets, the adjustability can be provided by moving parts of the helmet to change the outer and inner dimensions of the helmet. This can be achieved by having a helmet with two or more parts which can move with respect to each other. In other cases, e.g. commonly in cycling helmets, the helmet is provided with an attachment device for fixing the helmet to the user's head, and it is the attachment device that can vary in dimension to fit the user's head whilst the main body or shell of the helmet remains the same size. Such attachment devices for seating the helmet on a user's head may be used together with additional strapping (such as a chin strap) to further secure the helmet in place. Combinations of these adjustment mechanisms are also possible.

Helmets are often made of an outer shell, that is usually hard and made of a plastic or a composite material, and an energy absorbing layer called a liner. Nowadays, a protective helmet has to be designed so as to satisfy certain legal requirements which relate to, inter alia, the maximum acceleration that may occur in the centre of gravity of the brain at a specified load. Typically, tests are performed, in which what is known as a dummy skull equipped with a helmet is subjected to a radial blow towards the head. This has resulted in modern helmets having good energy-absorption capacity in the case of blows radially against the skull. Progress has also been made (e.g. WO 2001/045526 and WO 2011/139224, which are both incorporated herein by reference, in their entireties) in developing helmets to lessen the energy transmitted from oblique blows (i.e. which combine both tangential and radial components), by absorbing or dissipating rotational energy and/or redirecting it into translational energy rather than rotational energy.

Such oblique impacts (in the absence of protection) result in both translational acceleration and angular acceleration of the brain. Angular acceleration causes the brain to rotate within the skull creating injuries on bodily elements connecting the brain to the skull and also to the brain itself.

Examples of rotational injuries include Mild Traumatic Brain Injuries (MTBI) such as concussion, and more severe traumatic brain injuries such as subdural haematomas (SDH), bleeding as a consequence of blood vessels rapturing, and diffuse axonal injuries (DAI), which can be summarized as nerve fibres being over stretched as a consequence of high shear deformations in the brain tissue.

Depending on the characteristics of the rotational force, such as the duration, amplitude and rate of increase, either concussion, SDH, DAI or a combination of these injuries can be suffered. Generally speaking, SDH occur in the case of accelerations of short duration and great amplitude, while DAI occur in the case of longer and more widespread acceleration loads.

Helmets are known in which an inner shell and an outer shell are able to slide relative to each other under an oblique impact to mitigate against injuries caused by angular components of acceleration (e.g. WO 2001/045526 and WO 2011/139224). However, present solutions, often require complex components to allow the helmet shells to remain connected while still allowing sliding. This can make such helmets expensive manufacture. Also, present solutions are typically bulky and take up a large amount of space in the helmet. Further, existing helmets cannot easily be adapted to allow sliding. The present invention aims to at least partially address one ore more of these problems.

A first aspect of the disclosure provides a helmet comprising: inner and outer shells configured to slide relative to each other; and a connector connecting the inner and outer shells so as to allow the inner and the outer shells to slide relative to each other, the connector comprising: an attachment part attached to one of the inner shell and the outer shell; wherein: the attachment part comprises one or more protrusions and the inner or outer shell attached to the attachment part comprises one or more channels into which the protrusions extend, the protrusions and channels are configured such that the protrusions can move within the channels in an extension direction of the protrusions, during sliding of the inner and outer shells relative to each other, and the protrusions comprise an abutment member configured to abut an abutment portion of the channel to prevent the protrusion leaving the channel.

Optionally, the abutment member comprises one or more projections extending outwardly from an elongate main portion of the protrusion, the projections being configured to abut the abutment portion of the channel to prevent the protrusion leaving the channel. Optionally, the projections are angled away from a distal end of the protrusion.

Optionally, the abutment member is elastically deformable such that the protrusion can be inserted into the channel when the abutment member is in a deformed state and the abutment member prevents the protrusion leaving the channel when the abutment member is in an un-deformed state.

Optionally, the projections are configured to elastically deform by bending relative to the elongate main portion of the protrusion. Alternatively, the elongate main portion of the protrusion may be configured to elastically deform.

Optionally, the elongate main portion of the protrusion comprises a slot extending in the extension direction of the protrusion, the projections are provided adjacent the slot, and the elongate main portion of the protrusion is configured to deform by bending so as to narrow the slot.

Optionally, the channel comprises an entrance that is narrower than a main portion of the channel for accommodating the protrusion, and the abutment portion of the channel is a wall forming the entrance to the channel.

Optionally, the channel comprises a spring member configured to damp or slow the movement of the protrusion out of the channel.

Optionally, the wall of the channel is provided by a bracket provided within the inner or outer shell comprising the channel.

Optionally, the bracket is formed from a relatively hard material relative to the inner or outer shell comprising the channel.

Optionally, the material forming the inner or outer shell comprising the channel is moulded around the bracket.

Optionally, the protrusions extends in a direction substantially parallel to an extension direction of the inner and outer shells, or substantially perpendicular to a radial direction of the helmet.

Optionally, the connector further comprises a further attachment part attached to the other of the inner and outer shells; and one or more resilient structures extending between the attachment parts and configured to connect the attachment parts so as to allow the attachment parts to move relative to each other as the resilient structures deform.

Optionally, the direction of the relative movement between the attachment parts is parallel to a direction of said relative sliding between the inner shell and the outer shell of the helmet Optionally, the resilient structures extend in a direction substantially parallel to an extension direction of the outer shell and inner shell, or substantially perpendicular to a radial direction of the helmet.

Optionally, the first attachment part and the second attachment part are configured so as to be separated in a direction perpendicular to a radial direction of the helmet, said separation being increased/decreased by the relative movement between the attachment parts.

Optionally, the attachment parts and the resilient structures are arranged so as to be bisected by a plane perpendicular to a radial direction of the helmet.

Optionally, the attachment parts are configured to move relative to each other substantially in a plane perpendicular to a radial direction of the helmet.

Optionally, the further attachment part is arranged to at least partially surround the attachment part.

A second aspect of the disclosure provides a connector for use in the helmet of the first aspect, for connecting the inner and outer shells so as to allow the inner and outer shells to slide relative to each other, the connector comprising: an attachment part configured to be attached to one of the inner shell and the outer shell; wherein: the attachment part comprises one or more protrusions, the protrusions being configured to extend into one or more channels in the inner or outer shell to which the attachment part is configured to be attached, the protrusions are configured so as to move within the channels in an extension direction of the protrusions, during sliding of the inner and outer shells relative to each other, and the protrusions comprise an abutment member configured to abut a portion of the channel to prevent the protrusion leaving the channel.

A third aspect of the disclosure provides a bracket for use in the helmet of claims of the first aspect, the bracket comprising: a channel configured such that a protrusion of the connector can extend into the channel and configured such that the protrusion can move within the channel in an extension direction of the protrusions, during sliding of the inner and outer shells relative to each other; wherein the channel comprises an abutment portion configured to abut an abutment member of the protrusion to prevent the protrusion leaving the channel.

A fourth aspect of the disclosure provides a kit of parts comprising: the connector of the second aspect and the bracket of the second aspect. Optionally, the kit of parts further comprises a helmet comprising an inner shell and an outer shell configured to slide relative to each other.

The invention is described below by way of non-limiting examples, with reference to the accompanying drawings, in which.

Figure 7:
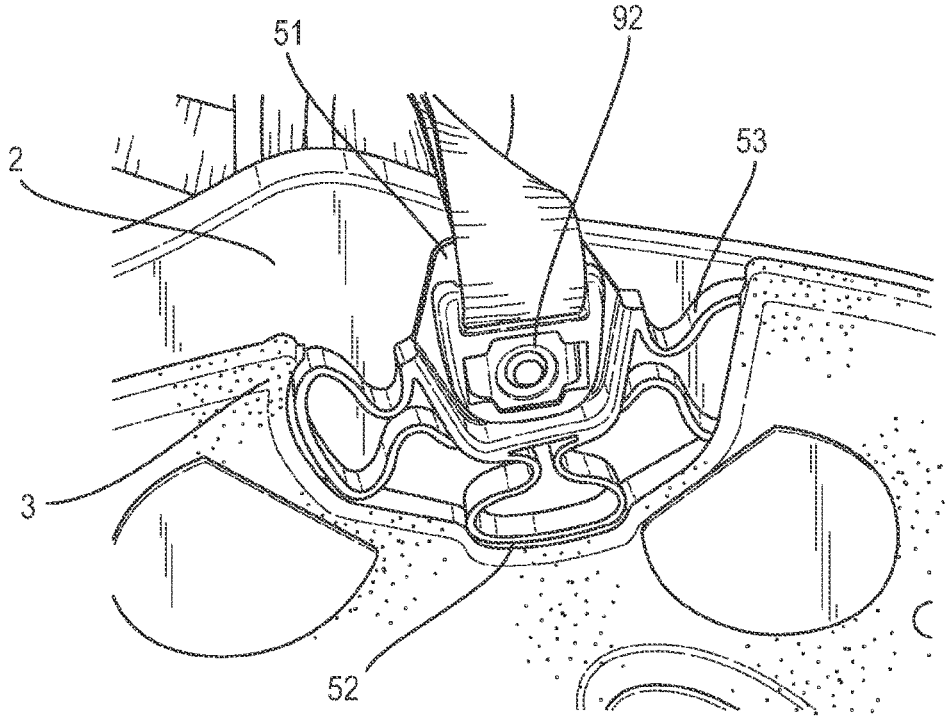
Figure 8:
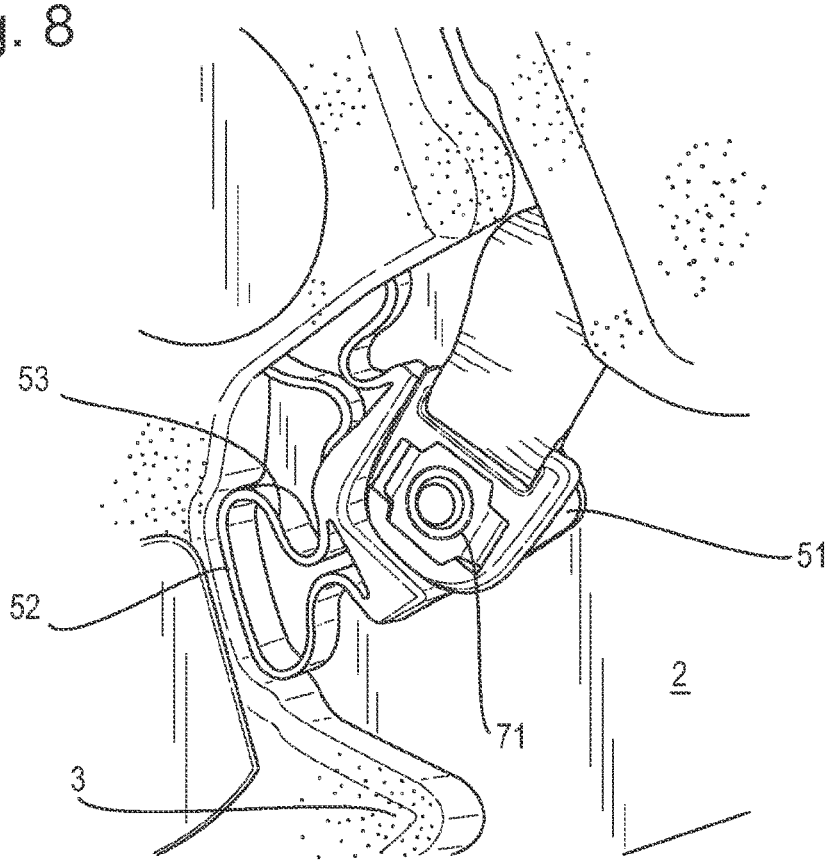
Figure 9:
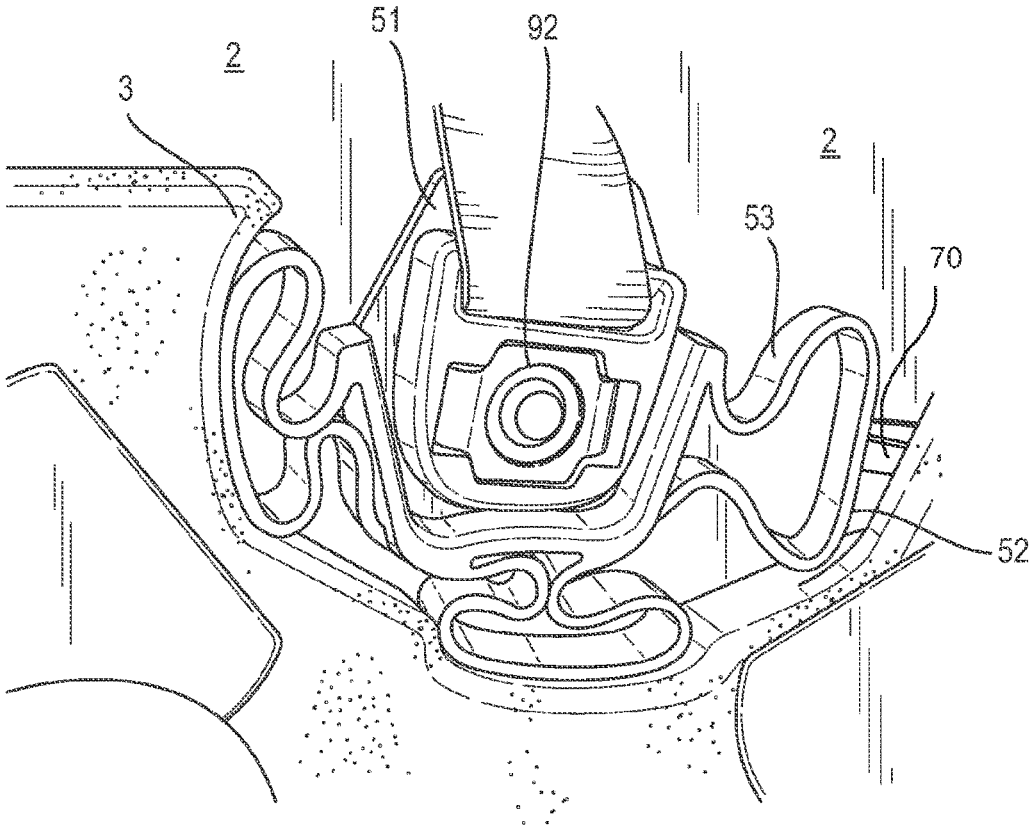

FIG. 7 and FIG. 8 respectively show front and rear connectors in a neutral position;

FIG. 9 shows the connector of FIG. 7 in a deformed position.

Figure 16:
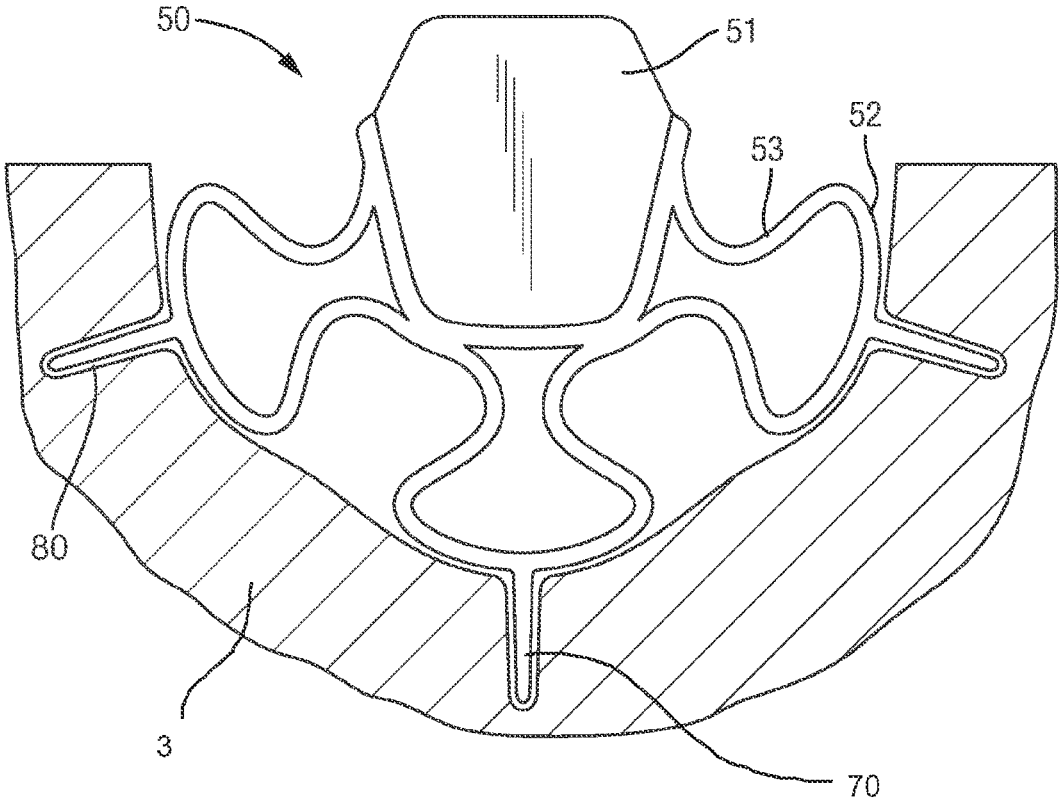
Figure 17:
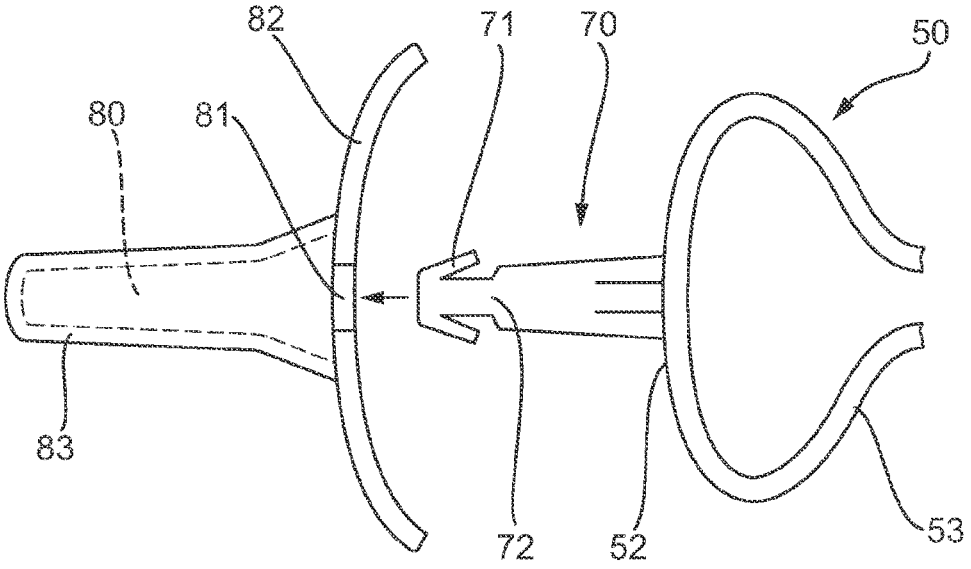
Figure 18:
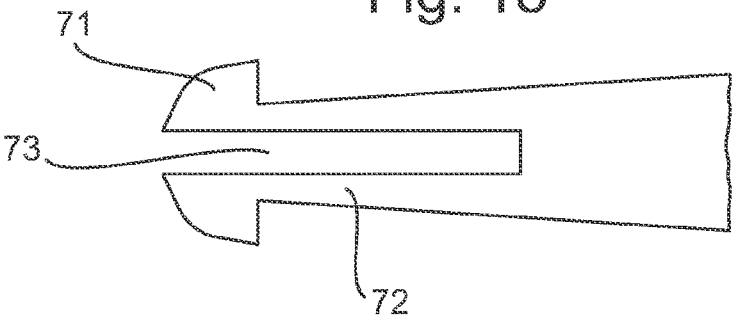
Figure 19:
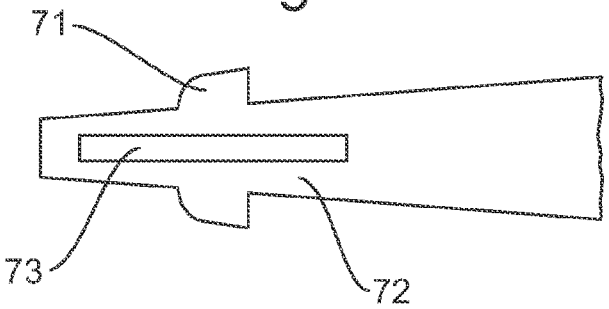
Figure 20:
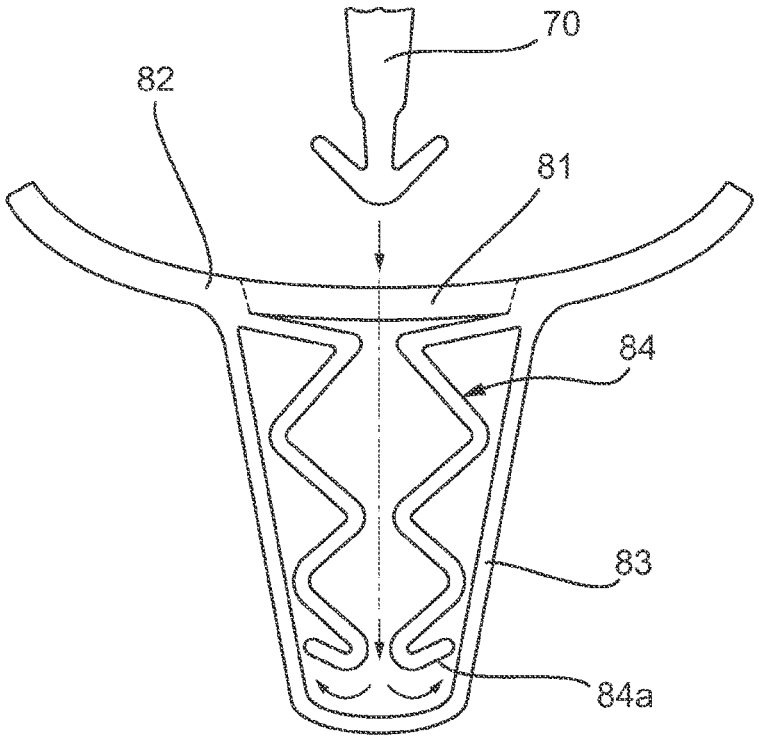
Figure 21:
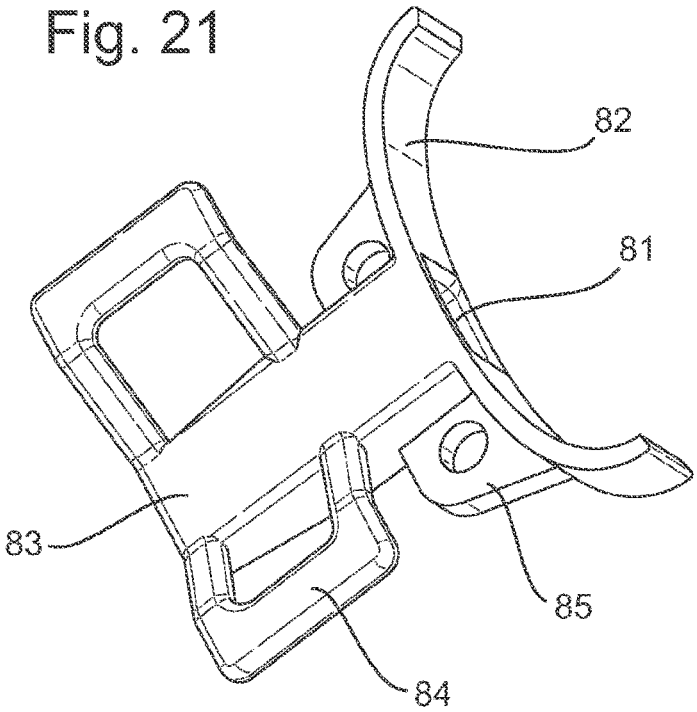

FIGS. 10 to 15 show different example resilient structures;

FIG. 16 shows an example connector connected to the inner shell of a helmet;

FIG. 17 shows a first embodiment of a connector and channel according to the disclosure;

FIG. 18 shows a second embodiment of a connector according to the disclosure;

FIG. 19 shows a third embodiment of a connector according to the disclosure;

FIG. 20 shows a second embodiment of a channel according to the disclosure;

FIG. 21 is an orthogonal view of the first and second embodiments of the channel.

Figure 22:
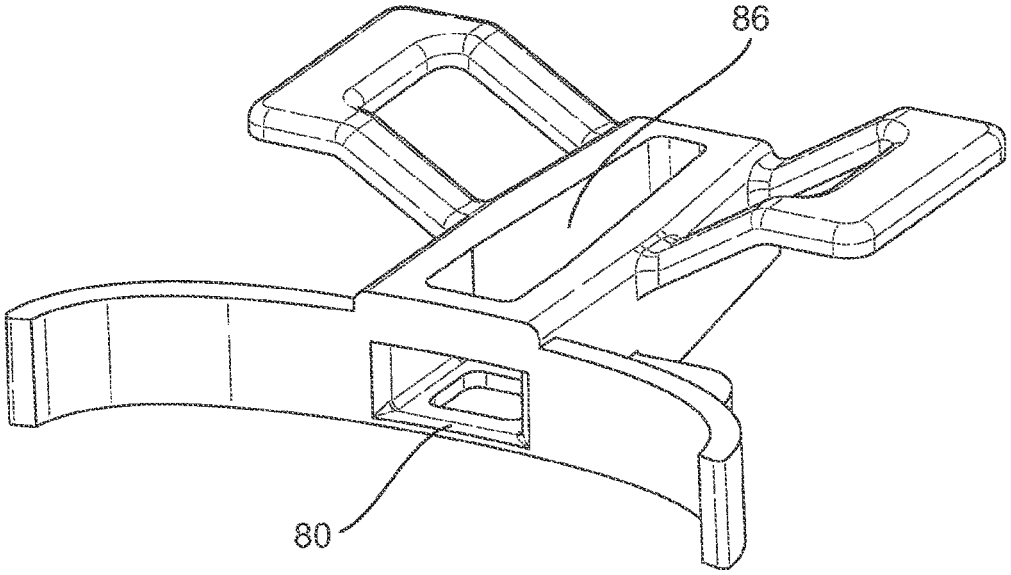
Figure 23:
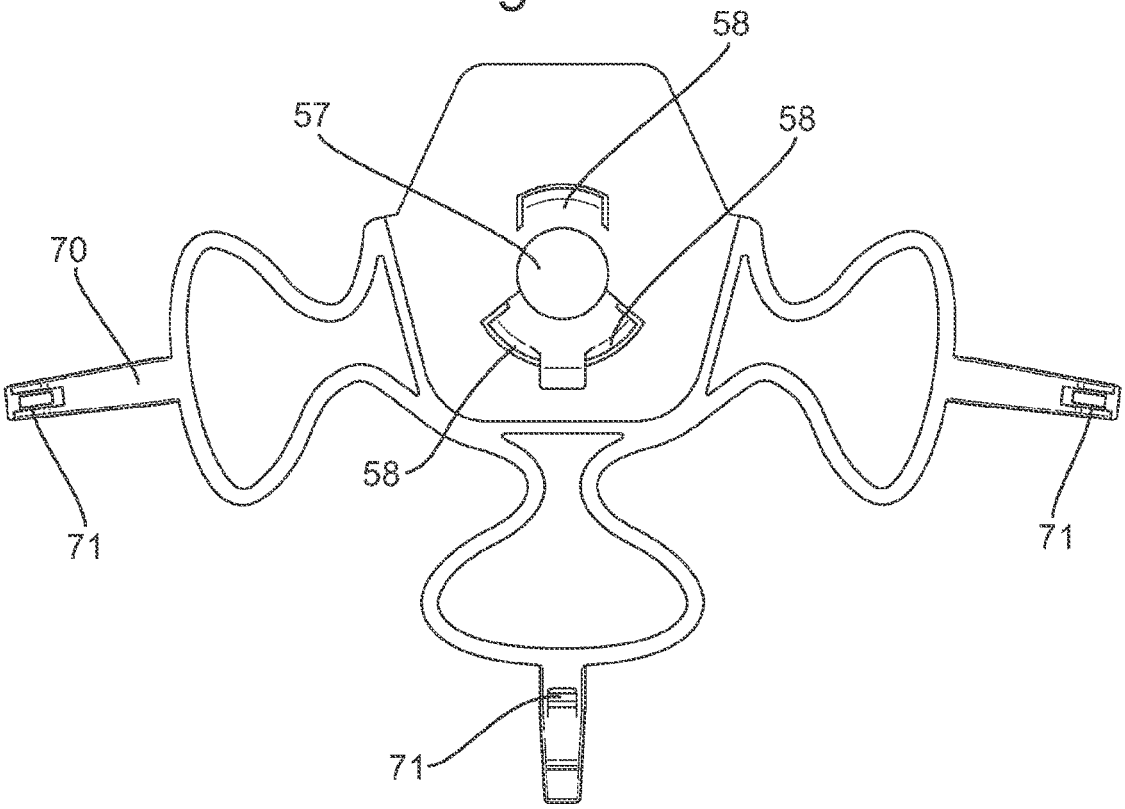
Figure 24:
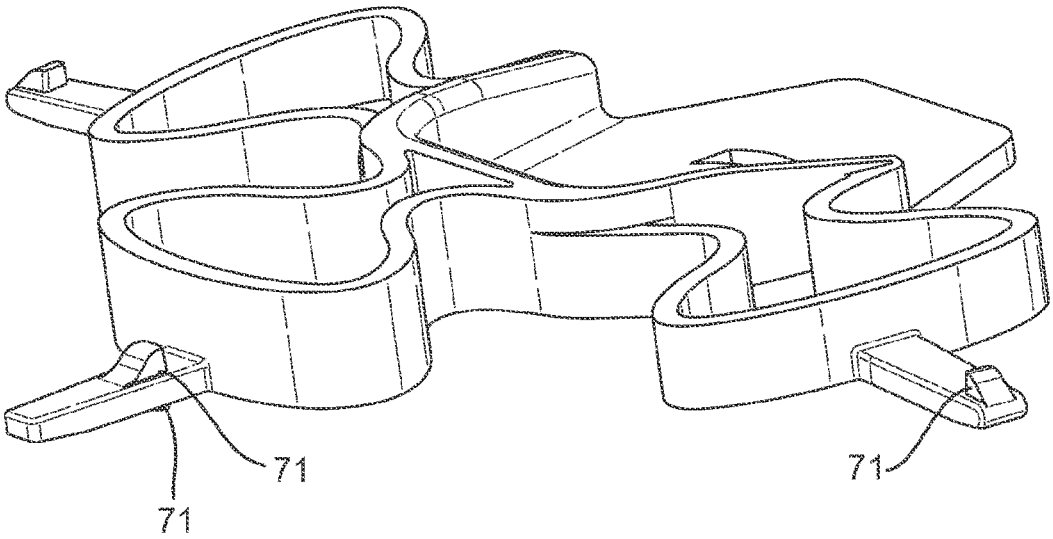
Figure 25:
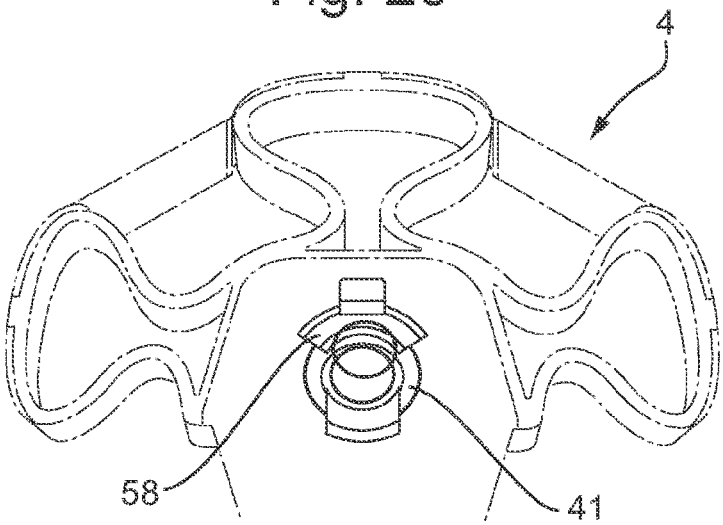

FIG. 22 shows an example bracket;

FIG. 23 shows an example connector;

FIG. 24 shows an example connector;

FIG. 25 shows a snap-fit connection of the connector with a partially transparent intermediate layer.

The proportions of the thicknesses of the various layers and spacing between the layers in the helmets depicted in the figures have been exaggerated in the drawings for the sake of clarity and can of course be adapted according to need and requirements.

Figure 1:
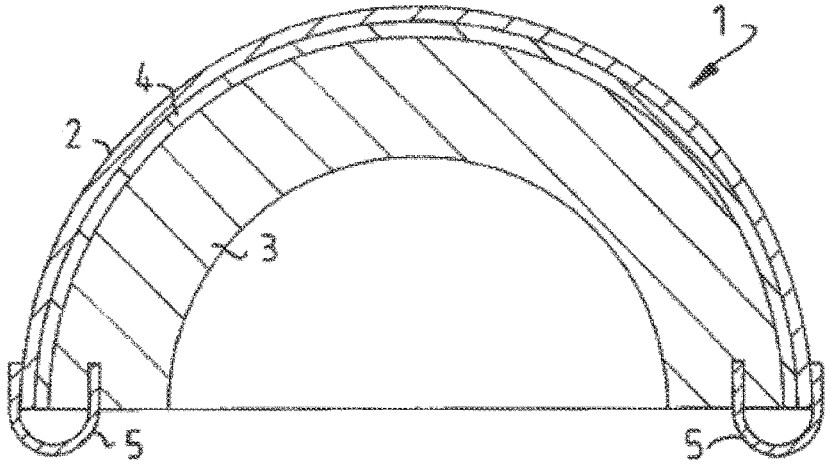
FIG. 1 depicts a cross section through a helmet for providing protection against oblique impacts.

FIG. 1 depicts a first helmet 1 of the sort discussed in WO 01/45526, intended for providing protection against oblique impacts. This type of helmet could be any of the types of helmet discussed above.

Protective helmet 1 is constructed with an outer shell 2 and, arranged inside the outer shell 2, an inner shell 3. An additional attachment device may be provided that is intended for contact with the head of the wearer.

Arranged between the outer shell 2 and the inner shell 3 is an intermediate layer 4 or a sliding facilitator, and thus makes possible displacement between the outer shell 2 and the inner shell 3. In particular, as discussed below, an intermediate layer 4 or sliding facilitator may be configured such that sliding may occur between two parts during an impact. For example, it may be configured to enable sliding under forces associated with an impact on the helmet 1 that is expected to be survivable for the wearer of the helmet 1. In some arrangements, it may be desirable to configure the sliding layer or sliding facilitator such that the coefficient of friction is between 0.001 and 0.3 and/or below 0.15.

Arranged in the edge portion of the helmet 1, in the FIG. 1 depiction, may be one or more connecting members 5 which interconnect the outer shell 2 and the inner shell 3. In some arrangements, the connecting members 5 may counteract mutual displacement between the outer shell 2 and the inner shell 3 by absorbing energy. However, this is not essential. Further, even where this feature is present, the amount of energy absorbed is usually minimal in comparison to the energy absorbed by the inner shell 3 during an impact. In other arrangements, connecting members 5 may not be present at all.

Further, the location of these connecting members 5 can be varied. For example, the connecting members may be positioned away from the edge portion, and connect the outer shell 2 and the inner shell 3 through the intermediate layer 4

The outer shell 2 may be relatively thin and strong so as to withstand impact of various types. The outer shell 2 could be made of a polymer material such as polycarbonate (PC), polyvinylchloride (PVC) or acrylonitrile butadiene styrene (ABS) for example. Advantageously, the polymer material can be fibre-reinforced, using materials such as glass-fibre, Aramid, Twaron, carbon-fibre, Kevlar or ultrahigh molecular weight polyethylene (UHMWPE).

The inner shell 3 is considerably thicker and acts as an energy absorbing layer. As such, it is capable of damping or absorbing impacts against the head. It can advantageously be made of foam material like expanded polystyrene (EPS), expanded polypropylene (EPP), expanded polyurethane (EPU), vinyl nitrile foam; or other materials forming a honeycomb-like structure, for example; or strain rate sensitive foams such as marketed under the brand-names Poron™ and D3O™. The construction can be varied in different ways, which emerge below, with, for example, a number of layers of different materials.

Inner shell 3 is designed for absorbing the energy of an impact. Other elements of the helmet 1 will absorb that energy to a limited extend (e.g. the hard outer shell 2 or so-called 'comfort padding' provided within the inner shell 3), but that is not their primary purpose and their contribution to the energy absorption is minimal compared to the energy absorption of the inner shell 3. Indeed, although some other elements such as comfort padding may be made of 'compressible' materials, and as such considered as 'energy absorbing' in other contexts, it is well recognised in the field of helmets that compressible materials are not necessarily 'energy absorbing' in the sense of absorbing a meaningful amount of energy during an impact, for the purposes of reducing the harm to the wearer of the helmet.

A number of different materials and embodiments can be used as the intermediate layer 4 or sliding facilitator, for example oil, gel, Teflon, microspheres, air, rubber, polycarbonate (PC), a fabric material such as felt, etc. Such a layer may have a thickness of roughly 0.1-5 mm, but other thicknesses can also be used, depending on the material selected and the performance desired. A layer of low friction plastics material such as PC is preferable for the intermediate layer 4. This may be moulded to the inside surface of the outer shell 2 (or more generally the inside surface of whichever layer it is directly radially inward of), or moulded to the outer surface of the inner shell 3 (or more generally the outside surface of whichever layer it is directly radially outward of). The number of intermediate layers and their positioning can also be varied, and an example of this is discussed below (with reference to FIG. 3B).

As connecting members 5, use can be made of, for example, deformable strips of rubber, plastic or metal. These may be anchored in the outer shell and the inner shell in a suitable manner.

Figure 2:
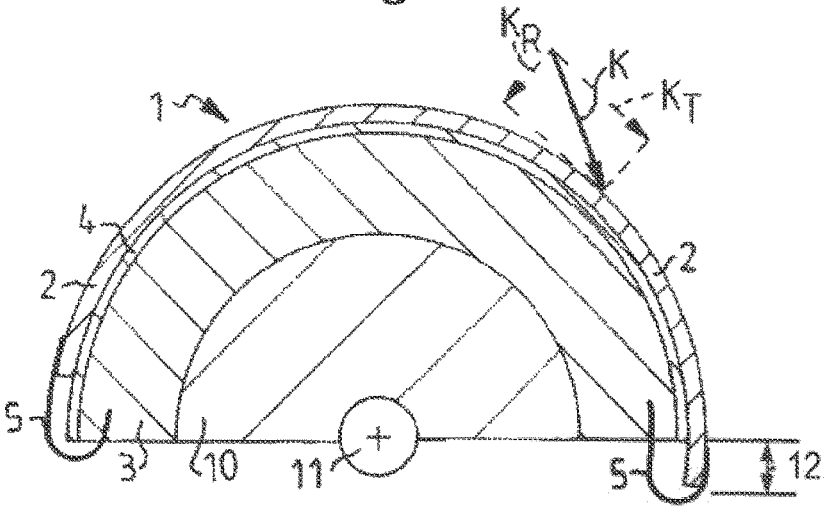
FIG. 2 is a diagram showing the functioning principle of the helmet of FIG. 1.

FIG. 2 shows the functioning principle of protective helmet 1, in which the helmet 1 and a skull 10 of a wearer are assumed to be semi-cylindrical, with the skull 10 being mounted on a longitudinal axis 11. Torsional force and torque are transmitted to the skull 10 when the helmet 1 is subjected to an oblique impact K. The impact force K gives rise to both a tangential force KT and a radial force KR against the protective helmet 1. In this particular context, only the helmet-rotating tangential force KT and its effect are of interest.

As can be seen, the force K gives rise to a displacement 12 of the outer shell 2 relative to the inner shell 3, the connecting members 5 being deformed. A reduction in the torsional force transmitted to the skull 10 of up to around 75%, and on average roughly 25% can be obtained with such an arrangement. This is a result of the sliding motion between the inner shell 3 and the outer shell 2 reducing the amount of rotational energy otherwise transferred to the brain.

Sliding motion can also occur in the circumferential direction of the protective helmet 1, although this is not depicted. This can be as a consequence of circumferential angular rotation between the outer shell 2 and the inner shell 3 (i.e. during an impact the outer shell 2 can be rotated by a circumferential angle relative to the inner shell 3). Although FIG. 2 shows the intermediate layer 4 remaining fixed relative to the inner shell 3 while the outer shell slides, alternatively, the intermediate layer 4 may remain fixed relative to the outer shell 2 while the inner shell 3 slides relative to the intermediate layer 4. Alternatively still, both the outer shell 2 and inner shell 3 may slide relative to the intermediate layer 4.

Figure 3A:
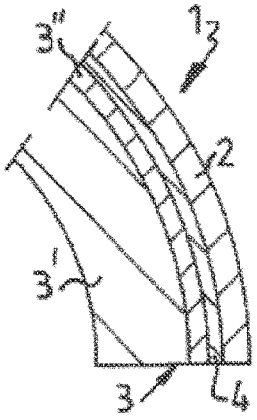
FIGS. 3A, 3B & 3C show variations of the structure of the helmet of FIG. 1.
Figure 3B:
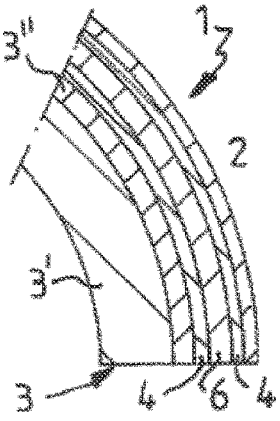
Figure 3C:
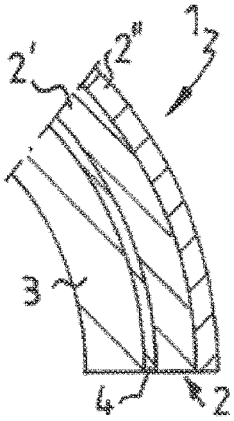

Other arrangements of the protective helmet 1 are also possible. A few possible variants are shown in FIG. 3. In FIG. 3*a*, the inner shell 3 is constructed from a relatively thin outer layer 3" and a relatively thick inner layer 3'. The outer layer 3" may be harder than the inner layer 3', to help facilitate the sliding with respect to outer shell 2. In FIG. 3*b*, the inner shell 3 is constructed in the same manner as in FIG. 3*a*. In this case, however, there are two intermediate layers 4, between which there is an intermediate shell 6. The two intermediate layers 4 can, if so desired, be embodied differently and made of different materials. One possibility, for example, is to have lower friction in the outer intermediate layer than in the inner. In FIG. 3*c*, the outer shell 2 is embodied differently to previously. In this case, a harder outer layer 2" covers a softer inner layer 2'. The inner layer 2' may, for example, be the same material as the inner shell 3. Although, FIGS. 1 to 3 show no separation in a radial direction between the layers, there may be some separation between layers, such that a space is provided, in particular between layers configured to slide relative to each other.

Figure 4:
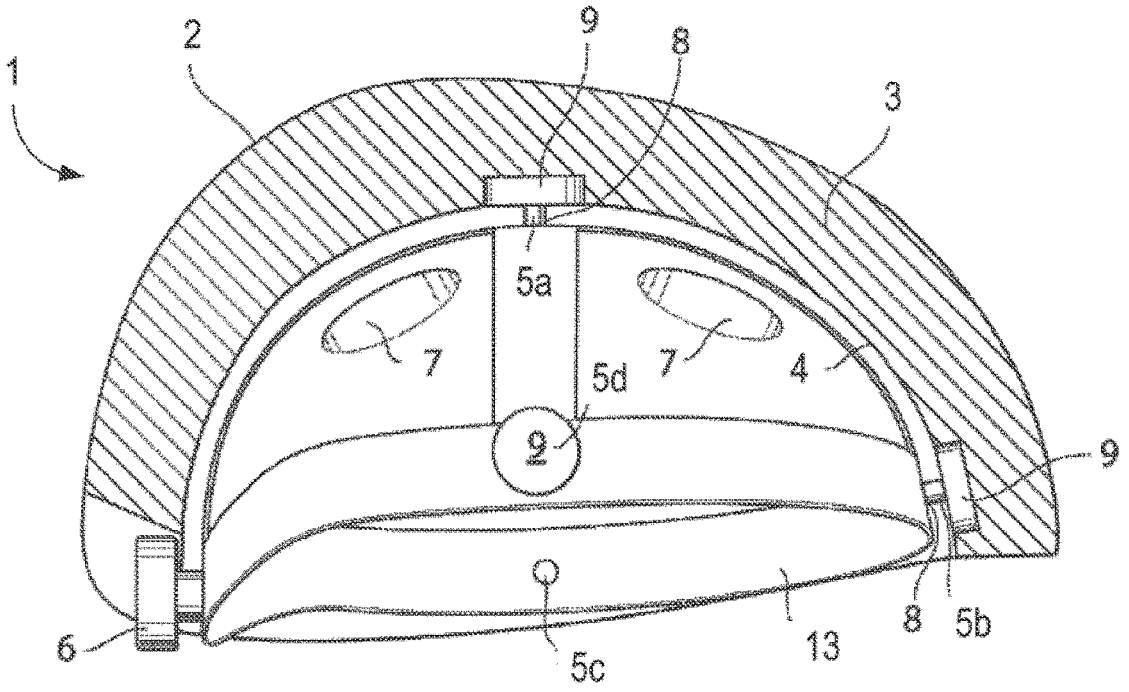
FIG. 4 is a schematic drawing of a another protective helmet.

FIG. 4 depicts a second helmet 1 of the sort discussed in WO 2011/139224, which is also intended for providing protection against oblique impacts. This type of helmet could also be any of the types of helmet discussed above.

In FIG. 4, helmet 1 comprises an energy absorbing layer 3, similar to the inner shell 3 of the helmet of FIG. 1. The outer surface of the energy absorbing layer 3 may be provided from the same material as the energy absorbing layer 3 (i.e. there may be no additional outer shell), or the outer surface could be a rigid shell 2 (see FIG. 5) equivalent to the outer shell 2 of the helmet shown in FIG. 1. In that case, the rigid shell 2 may be made from a different material than the energy absorbing layer 3. The helmet 1 of FIG. 4 has a plurality of vents 7, which are optional, extending through both the energy absorbing layer 3 and the outer shell 2, thereby allowing airflow through the helmet 1.

An attachment device 13 is provided, for attachment of the helmet 1 to a wearer's head. As previously discussed, this may be desirable when energy absorbing layer 3 and rigid shell 2 cannot be adjusted in size, as it allows for the different size heads to be accommodated by adjusting the size of the attachment device 13. The attachment device 13 could be made of an elastic or semi-elastic polymer material, such as PC, ABS, PVC or PTFE, or a natural fibre material such as cotton cloth. For example, a cap of textile or a net could form the attachment device 13.

Although the attachment device 13 is shown as comprising a headband portion with further strap portions extending from the front, back, left and right sides, the particular configuration of the attachment device 13 can vary according to the configuration of the helmet. In some cases the attachment device may be more like a continuous (shaped) sheet, perhaps with holes or gaps, e.g. corresponding to the positions of vents 7, to allow air-flow through the helmet.

FIG. 4 also depicts an optional adjustment device 6 for adjusting the diameter of the head band of the attachment device 13 for the particular wearer. In other arrangements, the head band could be an elastic head band in which case the adjustment device 6 could be excluded.

A sliding facilitator 4 is provided radially inwards of the energy absorbing layer 3. The sliding facilitator 4 is adapted to slide against the energy absorbing layer or against the attachment device 13 that is provided for attaching the helmet to a wearer's head.

The sliding facilitator 4 is provided to assist sliding of the energy absorbing layer 3 in relation to an attachment device 13, in the same manner as discussed above. The sliding facilitator 4 may be a material having a low coefficient of friction, or may be coated with such a material.

As such, in the FIG. 4 helmet, the sliding facilitator may be provided on or integrated with the innermost sided of the energy absorbing layer 3, facing the attachment device 13.

However, it is equally conceivable that the sliding facilitator 4 may be provided on or integrated with the outer surface of the attachment device 13, for the same purpose of providing slidability between the energy absorbing layer 3 and the attachment device 13. That is, in particular arrangements, the attachment device 13 itself can be adapted to act as a sliding facilitator 5 and may comprise a low friction material.

In other words, the sliding facilitator 4 is provided radially inwards of the energy absorbing layer 3. The sliding facilitator can also be provided radially outwards of the attachment device 13.

When the attachment device 13 is formed as a cap or net (as discussed above), sliding facilitators 4 may be provided as patches of low friction material.

The low friction material may be a waxy polymer, such as PTFE, ABS, PVC, PC, Nylon, PFA, FEP, PE and UHMWPE, or a powder material which could be infused with a lubricant. The low friction material could be a fabric material. As discussed, this low friction material could be applied to either one, or both of the sliding facilitator and the energy absorbing layer.

The attachment device 13 can be fixed to the energy absorbing layer 3 and/or the outer shell 2 by means of fixing members 5, such as the four fixing members 5*a*, 5*b*, 5*c* and 5*d* in FIG. 4. These may be adapted to absorb energy by deforming in an elastic, semi-elastic or plastic way. However, this is not essential. Further, even where this feature is present, the amount of energy absorbed is usually minimal in comparison to the energy absorbed by the energy absorbing layer 3 during an impact.

According to the embodiment shown in FIG. 4 the four fixing members 5*a*, 5*b*, 5*c* and 5*d* are suspension members 5*a*, 5*b*, 5*c*, 5*d*, having first and second portions 8, 9, wherein the first portions 8 of the suspension members 5*a*, 5*b*, 5*c*, 5*d* are adapted to be fixed to the attachment device 13, and the second portions 9 of the suspension members 5*a*, 5*b*, 5*c*, 5*d* are adapted to be fixed to the energy absorbing layer 3.

Figure 5:
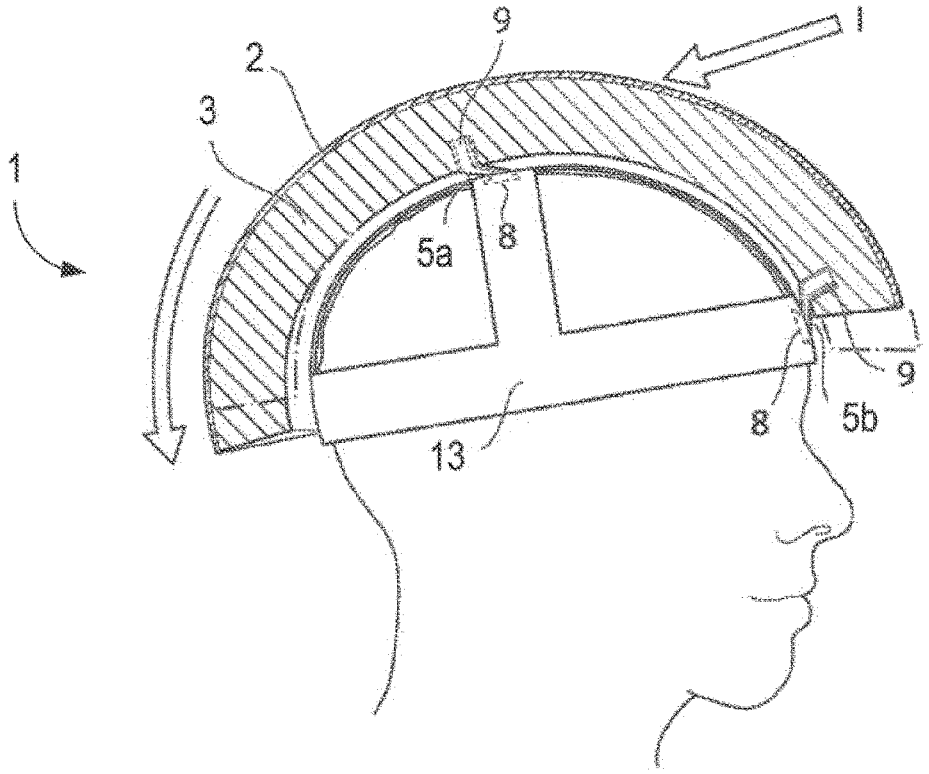
FIG. 5 depicts an alternative way of connecting the attachment device of the helmet of FIG. 4

FIG. 5 shows an example of a helmet similar to the helmet in FIG. 4, when placed on a wearers' head. The helmet 1 of FIG. 5 comprises a hard outer shell 2 made from a different material than the energy absorbing layer 3. In contrast to FIG. 4, in FIG. 5 the attachment device 13 is fixed to the energy absorbing layer 3 by means of two fixing members 5*a*, 5*b*, which are adapted to absorb energy and forces elastically, semi-elastically or plastically.

A frontal oblique impact I creating a rotational force to the helmet is shown in FIG. 5. The oblique impact I causes the energy absorbing layer 3 to slide in relation to the attachment device 13. The attachment device 13 is fixed to the energy absorbing layer 3 by means of the fixing members 5*a*, 5*b*. Although only two such fixing members are shown, for the sake of clarity, in practice many such fixing members may be present. The fixing members 5 can absorb the rotational forces by deforming elastically or semi-elastically. In other arrangements, the deformation may be plastic, even resulting in the severing of one or more of the fixing members 5. In the case of plastic deformation, at least the fixing members 5 will need to be replaced after an impact. In some case a combination of plastic and elastic deformation in the fixing members 5 may occur, i.e. some fixing members 5 rupture, absorbing energy plastically, whilst other fixing members 5 deform and absorb forces elastically.

In general, in the helmets of FIG. 4 and FIG. 5, during an impact the energy absorbing layer 3 acts as an impact absorber by compressing, in the same way as the inner shell of the FIG. 1 helmet. If an outer shell 2 is used, it will help spread out the impact energy over the energy absorbing layer 3. The sliding facilitator 4 will also allow sliding between the attachment device and the energy absorbing layer. This allows for a controlled way to dissipate energy that would otherwise be transmitted as rotational energy to the brain. The energy can be dissipated by friction heat, energy absorbing layer deformation or deformation or displacement of the fixing members. The reduced energy transmission results in reduced rotational acceleration affecting the brain, thus reducing the rotation of the brain within the skull. The risk of rotational injuries including MTBI and more severe traumatic brain injuries such as subdural haematomas, SDH, blood vessel rapturing, concussions and DAI is thereby reduced.

Figure 6:
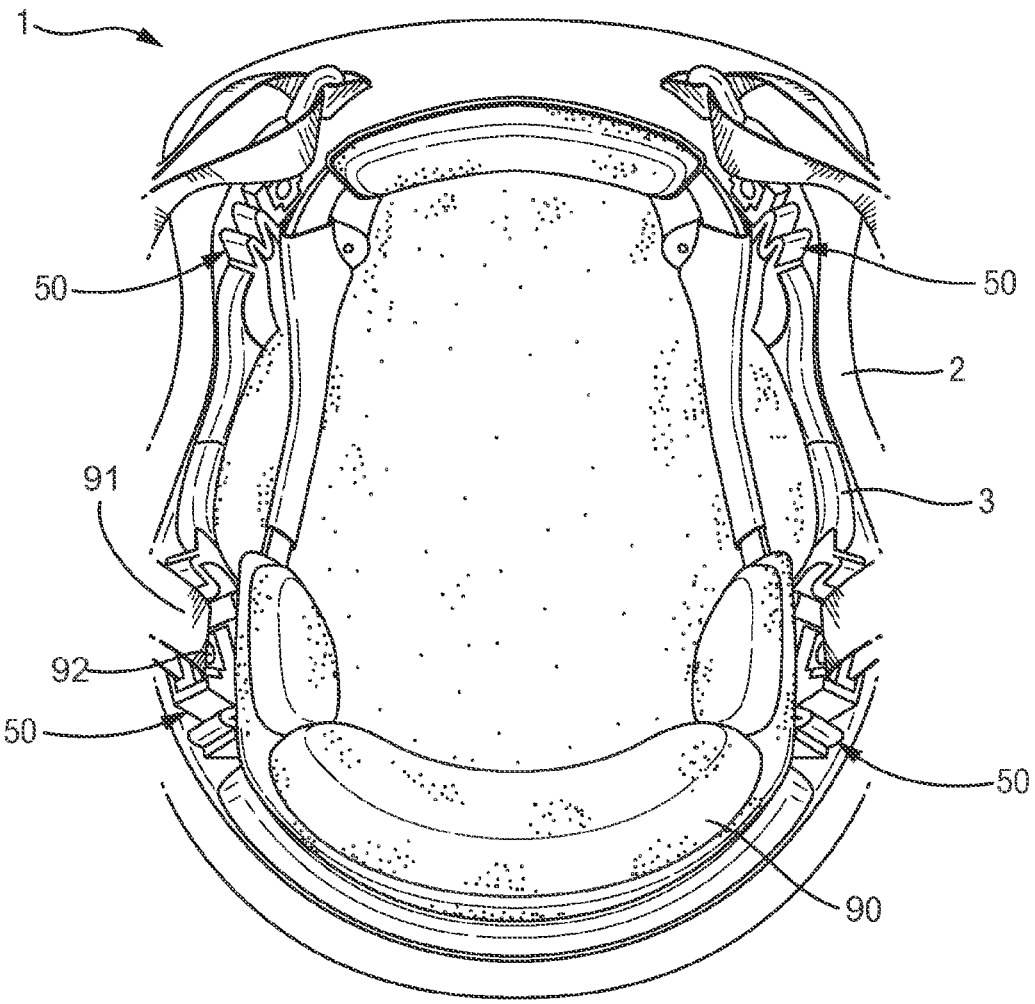
FIG. 6 shows the interior of a helmet comprising connectors in accordance with the invention.

FIG. 6 shows an example of a helmet 1 comprising an inner shell 3 and an outer shell 2. Inside the inner shell 3 is an optional comfort padding layer 90.

In the example helmet 1, a connector 50 is used to enable sliding between the inner shell 3 and the outer shell 2 of the helmet 1. Connectors 50 may be used alternatively or additionally to the connecting members 5 described above in relation to the helmets shown in FIGS. 1 to 5. An example connector 50 is shown in FIGS. 7 to 9 and comprises a first attachment part 51 for attaching to the outer shell 2 and a second attachment part 52 for attaching to the inner shell 3. However, in other examples the first attachment part 51 may attach to the inner shell 3 and the second attachment part 52 may attach to the outer shell 2. The first attachment part 51 is configured to move relative to the second attachment part 52. The relative movement between the first attachment part 51 and the second attachment part 52 allows sliding between the inner shell 3 and the outer shell 2 of the helmet 1.

The direction of the relative movement between the attachment parts 51, 52 may be parallel to a direction of said relative sliding between the inner shell and the outer shell of the helmet. The attachment parts 51, 52 may be configured to move relative to each other substantially in a plane perpendicular to a radial direction of the helmet 1. The first attachment part 51 and the second attachment part 52 may be configured so as to be separated in a direction perpendicular to a radial direction of the helmet 1, said separation being increased/decreased by the relative movement between the attachment parts 51, 52.

The sliding may be assisted by providing a sliding facilitator 4 between the outer surface of the inner shell 3 and the inner surface of the outer shell 2. For example, the sliding facilitator 4 may be a layer of low friction material, such as polycarbonate. This low friction layer may be on an inner surface of the outer shell 2 and/or an outer surface of the inner shell 2. The sliding facilitator 4, if provided in the form of a layer of low friction material (e.g. polycarbonate) may be attached to the inside surface of the outer shell 2 at the same location as the connectors 50.

Below, example connectors 50 will be described primarily with reference to the arrangement shown in FIG. 6, in which the first attachment part 51 is connected to the outer shell 2 and the second attachment part 52 is attached to the inner shell 3. However, it should be understood that the alternative arrangement is also possible, in which the first attachment part 51 is connected to the inner shell 3 and the second attachment part 52 is attached to the outer shell 2.

As shown in FIG. 7, the first attachment part 51 may be configured to be fixedly attached to the outer shell 2. The attachment may be in a substantially orthogonal direction to the extension direction of the outer shell 2. For example, as shown in FIG. 7, at the point of attachment, the outer shell 2 extends substantially in the plane of the page, whereas the first attachment part 51 is connected perpendicularly to the plane of the page a substantially left-to-right direction of the Figure. Alternatively the first attachment part 51 may be configured to be fixedly attached to the outer shell 2 in a direction parallel to the extension direction of the outer shell 2.

In the example helmet 1 shown in FIG. 6, the first attachment part 51 is attached to the outer shell 2 at one of multiple strap attachment points 2A of the outer shell 2 at which a strap 91 is attached to the outer shell 2. The connector 50 may be In this way, pre-existing strap attachment points may be used for connecting the inner and outer shells 3, 2 of the helmet 1, thus making efficient use of space. Further, this allows the connector 50 to be fitted retrospectively into pre-existing helmets.

FIGS. 7 to 9 respectively show close up views of front and rear connectors 50. In FIGS. 7 to 9 the comfort padding 90 is not shown. In the example helmet shown in FIG. 6, four strap attachment points 2A are provided in the helmet, and four corresponding connectors 50. However, any number of strap attachment points 2A and connectors 50 may be provided, e.g. 2 or 6. Typically the same number of strap attachment points 2A are provided on right and left sides of the helmet 1. These may be front and rear strap attachment points as shown in FIGS. 6, 7 and 8, e.g. placed to be located either side of the wearer's ear.

The first attachment part 51 may comprise a recess 56 configured to accommodate a strap attachment part 92 for attaching a strap 91 to the helmet 1. As shown in FIGS. 7 to 9 the strap attachment part 92 of the strap 91 may be configured to fit into the recess 56 of the first attachment part 51. Thus, the provision of the connector 50 does not require much additional space.

The recess 56 of the first attachment part 51 may formed by a first wall and an adjacent second wall of the first attachment part 51. The first wall may be configured to have a height direction substantially perpendicular to the extension direction of the outer shell 2, when the connector 50 is attached to the outer shell 2. The second wall may be configured to be formed in a plane substantially parallel to the extension direction of the outer shell 2, when the connector 50 is attached to the outer shell 2. Optionally a third wall may be provided parallel to and facing the second wall, the recess being the space between all three walls.

The first attachment part 51 may comprises one or more apertures 57 through which fixing means may pass for fixing the first attachment part 51 to the outer shell 2. A fixing means, e.g. a bolt, may pass through the strap attachment part 92 the first attachment part 51 and the outer shell 2 at the strap attachment point 2A to secure the structures together.

Accordingly, the recess 56 of the first attachment part 51 may comprise one or more apertures 57 and the one or more apertures 57 may be further configured such that fixing means may pass through for fixing the strap attachment part 92 to the first attachment part 51. Apertures 55 may be provided in the second wall and/or the third wall of the first attachment part 52 as described above.

Alternatively, or additionally, the strap attachment part 92 may be attached to the first attachment part 51 by other means, such a snap fit configuration. For example, the strap attachment part 92 and the first attachment part 51 may comprise mutually engaging structures that snap together to connect the strap attachment part 92 and the first attachment part 51 when the strap attachment part 92 is inserted into the recess 56 of the first attachment part 51.

In alternative example helmets, the first attachment part 51 may not be connected to the strap attachment part 92. The first connecting part 51 may connect to the outer shell 3 or sliding facilitator 4 on the inside surface of the outer shell 3 at a different location to the strap attachment part 92. In such a case the first attachment part 51 may not include a recess 56.

The connector 50 may comprise one or more resilient structures 53 extending between the first attachment part 51 and the second attachment part 52. The resilient structures may be configured to connect the first attachment part 51 and the second attachment part 52 so as to allow the first attachment part 51 to move relative to the second attachment 52 as the resilient structures 53 deform. The resilient structures 53 may extend from the first wall of the first attachment part 51 to the second attachment part 52.

The second attachment part 52 may be provided at an opposite end of the resilient structures 53 to the first attachment part 51. The second attachment part 52 may be formed in several discrete sections, each of the sections corresponding to a resilient structure 53, as shown in FIGS. 7 to 9. Alternatively, the second attachment part 52 may be formed as one continuous element, as shown in FIGS. 10 to 15.

The resilient structures 53 may extend in a direction substantially parallel to an extension direction of the outer shell 2 and inner shell 3, or substantially perpendicular to a radial direction of the helmet 1. The attachment parts 51, 52 and the resilient structures 53 may be arranged so as to be bisected by a plane perpendicular to a radial direction of the helmet.

Figure 10:
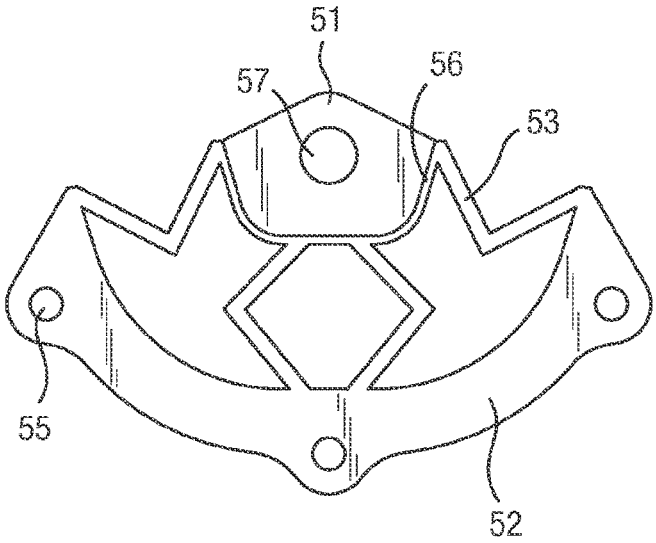

As shown in FIG. 10 for example, the second attachment part 52 may be arranged to at least partially surround the first attachment part 51. For example, the second attachment part 52 may be substantially arc shaped. Such an arrangement is most suitable for connectors 50 to be provided at the edge of the inner shell 3 or outer shell 2. The open side of the arc may be arranged to face away from the edge of the inner shell 3 or outer shell 2. In other examples, the second attachment part 52 may be arranged to completely surround the first attachment part 51. For example, the second attachment part 52 may form a closed loop, e.g. a circle, around the first attachment part 51. With such an arrangement, the connector 50 can be provided away from an edge of the inner shell 3. For example, the connector 50 may be completely embedded in the inner shell 3, e.g. near the crown of the helmet 1.

Each resilient structure 53 may be configured to deform (e.g. by compression/expansion) so as to change (e.g. decrease/increase) the distance between the first attachment part 51 and the second attachment part 52 at the location of the resilient structure. The extension direction of the resilient structures 53 may be perpendicular to a radial direction of the helmet, when the connector is connected to the helmet. The first attachment part 51, the second attachment part 52 and the resilient structures 53 may be configured so as to be bisected by a plane perpendicular to a radial direction of the helmet (i.e. a tangential direction), when the connector 50 is connected to the helmet. The first attachment part 51 and the second attachment part 52 may be configured to move relative to each other substantially in a plane perpendicular to a radial direction of the helmet, when the connector is connected to the helmet.

The first attachment part 51 and the second attachment part 52 may be separated in a direction perpendicular to a radial direction of the helmet, when the connector 50 is connected to the helmet. The separation may be increased/decreased by the relative movement between the first attachment part 51 and the second attachment part 52. The direction of the decrease/increase of the distance between the first attachment part 51 and the second attachment part 52 is configured to correspond to a direction in which sliding occurs between the outer an inner helmet shells 2, 3, i.e. in a direction perpendicular to a radial direction of the helmet (i.e. a tangential direction). This movement is shown by comparison between FIGS. 7 and 9. FIG. 7 shows a connector 50 in a neutral position, whereas FIG. 9 shown the same connector 50 when sliding occurs between the outer an inner helmet shells 2, 3.

The resilient structures 53 of the connector shown in FIG. 10 comprise at least one angular portion between the first attachment part 51 and the second attachment part 52, an angle of said angular portion being configured to change to allow relative movement between the first attachment part 51 and the second attachment part 52.

The resilient structures 53 may generally comprise two portions that extend in directions oblique to each other. These two portions may be connected at respective ends to form the angular portion. The angular portion may be a relatively sharp angle, e.g. with two straight sections meeting directly, or may be curved.

As shown in FIG. 10 the angular portion may be substantially V-shaped. The two ends of the V shape may be connected to the first attachment part 51 and the second attachment part 52 respectively. The ends of the V-shape means the non-connected ends of the two straight sections forming the V-shape. Substantially, V-shaped could apply to the sharp angle or curve described above, e.g. it also describes a U-shape.

Figure 11:
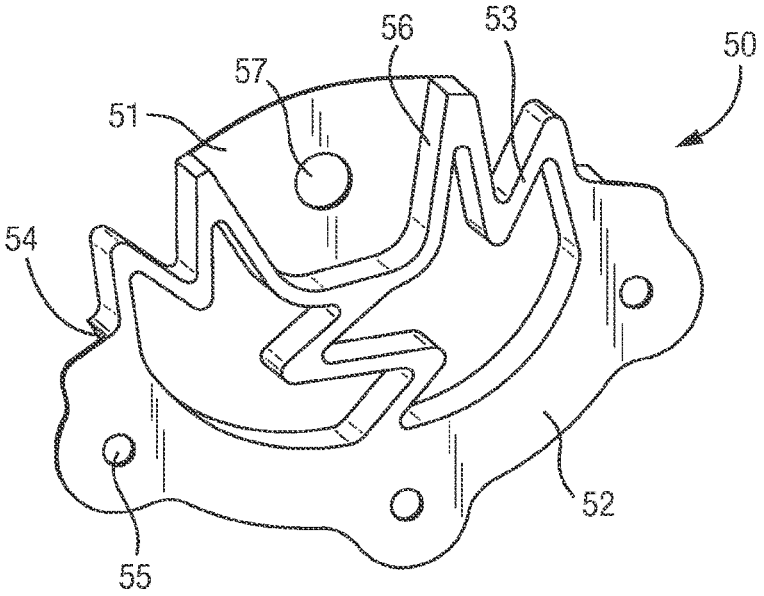

As shown in FIG. 11, the angular portion may be substantially Z-shaped, the two ends of the Z shape being connected to the first attachment part 51 and the second attachment part 52 respectively. As shown in FIG. 11 the two ends of the Z shape may be directly connected to the first attachment part 51 and the second attachment part 52. Alternatively, the two ends of the Z shape may be connected to the first attachment part 51 and the second attachment part 52 indirectly, for example by further substantially straight sections of the resilient structure 53. In this example, the Z-shape comprises two V-shapes that are connected together. However, any number of V-shapes may be connected in series.

Figure 12:
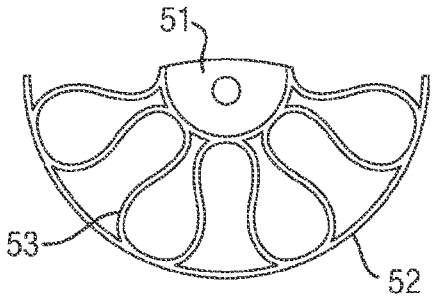

The resilient structures 53 of the connector 50 shown in FIG. 12 comprise at least one inflected portion between the first attachment part 51 and the second attachment part 52. The inflected portion may generally comprise three portions connected in series. The central portion extends in a direction substantially oblique to the directions in which the end two portions extend. In other words, the inflected portions comprise two angled portions, arranged such one of the angled portions forms an interior angle with respect to the central portion and the other form an exterior angle. That is, the inflected portion comprises two bends, in opposite directions.

An inflection amount of said inflected portion may be configured to change to allow relative movement between the first attachment part 51 and the second attachment part 52. Here a change in inflection amount means the inflected portion compresses or expands accordingly, e.g. the angles between the end portions and the central portion of the inflected portion change. The infected portion may be substantially S-shaped. The two ends of the S shape may be connected to a first attachment part 51 and the second attachment part 52 respectively.

Figure 13:
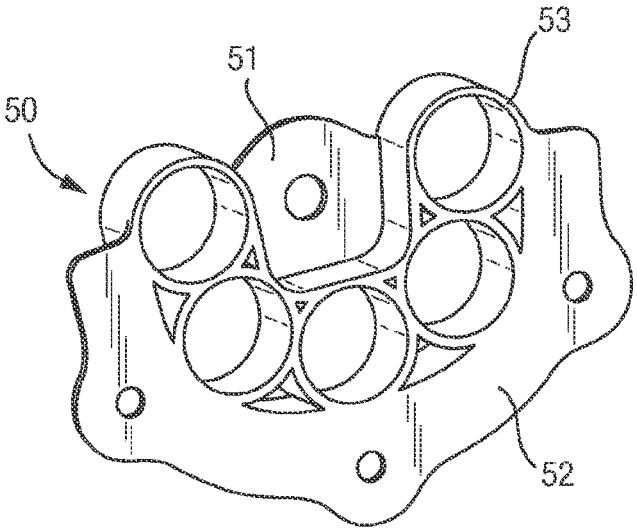

The resilient structures 53 of the connector 50 can comprise at least one loop-like portion. As shown in FIG. 13 the loop-like portions can comprise at least one loop, ring or elliptical portion (when in an un-deformed state) between the first attachment part 51 and the second attachment part 52. The shape of the loop-like portion may be configured to change to allow relative movement between the first attachment part 51 and the second attachment part 52. Two opposing sides of the loop-like portion may be connected to the first attachment part and the second attachment part respectively. The changing shape of the elliptical portion may mean a change in the eccentricity of the ellipse, for example from circular to non-circular, or may mean the ellipse is deformed in some other way, into a non-elliptical shape. The loop-like portions may be compressed or expanded accordingly, in one or more directions.

Figure 14:
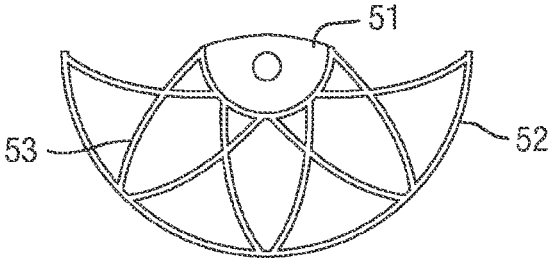

The resilient structures 53 shown in FIG. 14 comprises at least two intersecting parts between the first attachment part 51 and the second attachment part 52. The intersecting parts may cross at a point of intersection. The angle at which the two intersecting parts intersect may be configured to change to allow relative movement between the first attachment part 51 and the second attachment part 52. The intersecting parts may intersect to form a substantially X-shaped portion. A first two ends of the X shape may be connected to the first attachment part 51 and a second two ends of the X shape may be connected to the second attachment part 52.

As shown in FIG. 14, the intersecting parts may intersect at a single intersection point. In this example, the intersecting parts are formed from two curved portions, in this case arcs. However, these portions may alternatively be straight.

Alternatively, the intersecting parts may intersect at more than one intersecting point, e.g. two points. The two intersecting portions may be two curved portions, e.g., arcs, curving in opposite directions so as to form two overlapping U-shapes, one U-shape facing in one direction, the other U-shape facing substantially the opposite directions.

Alternatively, the intersecting parts may intersect to form a substantially Y-shaped portion. Two ends of the Y-shape may be connected to one of the first attachment part 51 and the second attachment part 52 and third end of the Y-shape may be connected to the other of the first attachment part 51 and the second attachment part 52.

Figure 15:
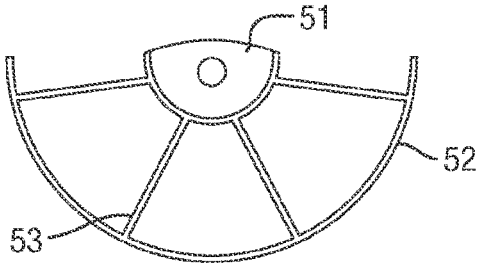

As shown in FIG. 15, the resilient structures 53 may comprise at least one straight portion between the first attachment part 51 and the second attachment part 52, the straight portion being configured to bend to allow relative movement between the first attachment part 51 and the second attachment part 52. The straight portions may extend substantially radially between the attachment parts 51, 52 or obliquely to a radial direction.

In each of the above examples, the specific shapes of the resilient structures described may be formed in a plane that encompasses the extension direction of the resilient structures 53. However, the connectors 50 are not necessarily flat, they may be curved e.g. formed to follow a curvature of the inner and/or outer shells 3, 2 of the helmet 1. In that case, the specific shapes above, may be formed in a curved surface that encompasses the extension directions of the resilient structures 53.

In the case of multiple resilient structured 53 being provided for a given connector 50, different resilient structures 53 may have different resiliencies. In other words, the stiffness of the resilient structures 53 may be different from one another so as to provide different spring forces.

Providing different stiffnesses between resilient structures 53 allows greater control of the relative movement of the helmet shells 2, 3. For example, selecting the stiffnesses appropriately may allow more freedom of movement in one direction than another.

Alternatively, stiffnesses may be selected in order to provide even resilience in all directions. For example, the example shown in FIG. 7 has three resilient structures 53, two of those being on opposite sides of the connector 50. Therefore the stiffness in the side-to-side direction of the Figures would be approximately twice as great as the stiffness in the up-to-down direction, if each resilient structure 53 had the same stiffness. Therefore reducing the stiffness of the two resilient structures at the sides by about half would result in a more even resilience of the connector 50 as a whole.

There are many different ways that the stiffness of the resilient structures 53 can be controlled. For example, different materials with different stiffnesses could be used to form the resilient structures 53. The resilient structures 53 may have different shapes (e.g. one of those described above), different lengths, different thicknesses or different widths for example. The resilient structures 53 may include apertures, notches or other configurations in which material is removed from the resilient structures 53 to reduce the stiffness. For the resilient structures having different thicknesses (i.e. in the direction parallel to the thickness direction of the inner shell 3), the two resilient structures 53 on opposite sides of the connector 50 may be thinner than the central resilient structure 53.

The connectors 50 may be formed from a resilient material, e.g. a polymer, such as rubber or plastic, for example, thermoplastic polyurethane, thermoplastic elastomers or silicone. The connectors 50 may be formed by injection moulding. The entire connector 50 may be formed of a resilient material. Alternatively, the resilient structures 53 may be formed from a resilient material and the first attachment part 51 and/or second attachment part 52 may be formed from a different, e.g. harder, material. In this case, the connector 50 may be formed by co-moulding a resilient material and a harder material.

In an example helmet according to the present disclosure, the second attachment part 52 comprises one or more protrusions 70 and the inner shell 3 comprises one or more channels 80 into which the protrusions 70 extend. Such an arrangement is shown in FIG. 16. The second attachment part 52 can be attached to the inner shell 3 by the protrusions 70 engaging with corresponding channels 80. In other examples, the channels may be provided in the outer shell 2 and the second attachment part 52 may attach to the outer shell 2.

The protrusions 70 and channels 80 are configured such that the protrusions 70 can move within the channels 80 in an extension direction of the protrusions 70, during sliding of the inner and outer shells 3, 2 relative to each other. The protrusions 70 comprise an abutment member configured to abut an abutment portion of the channel 80 to prevent the protrusion 70 leaving the channel 80.

FIG. 17 shows a first embodiment of a connector 50 according to the present disclosure. FIG. 17 specifically shows a part of a second attachment part 52 of a connector comprising a protrusion 70. As shown, the protrusion 70 extends in a direction substantially parallel to the extension direction of the inner and outer shells 3, 2, or a direction substantially perpendicular to a radial direction of the helmet 1. The protrusion 70 extends substantially in the extension direction of the resilient structures 53 of the connector 50. The protrusion 70 extends in a direction substantially perpendicular to the second attachment part 52.

The protrusion 70 comprises an abutment member. In this embodiment, the abutment member comprises two projections 71 extending outwardly from an elongate main portion 72 of the protrusion 70. In other examples, one or more projections 71 may be provided. In this embodiment, the projections 71 are elongate. The projection 71, as shown, are angled away from a distal end of the protrusion 70. That is, the protrusions 71 extend in a direction from the distal end towards the proximal end of the protrusion 70.

The projections 71 are configured to elastically deform by bending relative to the elongate main portion 72 of the protrusion 70. Specifically, the projections 71 are configured to flatten against the elongate main portion 72 of the protrusion 70 to reduce the width of the protrusion and allow it to fit into the channel 80 in the inner shell 3 of the helmet 1.

FIGS. 18 and 19 respectively show second and third embodiments of a connector according to the present disclosure, specifically the protrusions 70 thereof. In these embodiments, similarly to the first embodiment, the abutment member 70 comprises projections 71 extending outwardly from an elongate main portion 72 of the protrusion 70. However, in the second and third embodiments, the elongate main portion 72 of the protrusion is configured to elastically deform, rather than the projections 71. In particular, the elongate main portion 72 of the protrusion 70 comprises a slot 73 extending in an extension direction of the protrusion 70. Projections 71 are provided adjacent slots 73. The elongate main portion 72 of the protrusion 70 is configured to deform by bending so as to narrow the slots 73. The slot 73 is provided through the entire protrusion 70 in a thickness direction thereof (into the page of the Figures). In the second embodiment of FIG. 18, the slot 73 is open at a distal end of the protrusion 70. On the other hand, in the third embodiment of FIG. 19, the slot 73 is closed at a distal end of the protrusion.

In each of the embodiments described in connection with FIGS. 17 to 19, the abutment member is configured to abut an abutment portion of the channel 80 in order to prevent the protrusion from leaving the channel. Specifically, the projections 71 on the protrusions 70 are configured to abut the abutment portion of the channel 80 to prevent to the protrusion leaving the channel 80.

In each of the embodiments described in connection with FIGS. 17 to 19, the abutment member is elastically deformable so that the protrusion 70 can be inserted into the channel 80 when the abutment member is in a deformed state and the abutment member prevents the protrusion leaving the channel 80 when the abutment member is in an un-deformed state. In the first embodiment of FIG. 17, the protrusions 71 specifically are deformable, whereas in the second and third embodiments of FIGS. 18 and 19, the elongate main portion 72 of the protrusion 70 is deformable.

FIG. 17 also shows a first embodiment of a channel 80 according to the present disclosure. The channel 80 comprises an entrance 81 through which the protrusion 70 may be inserted. The channel 80 also comprises a main portion for accommodating the inserted protrusion 70. The entrance 81 of the channel 80 may be narrower than the main portion of the channel 80. Accordingly, the abutment portion of the channel 80 may be a wall 82 forming the entrance 81 to the channel 80. In other words, the wall 83 forming the entrance of the channel 80 and the projections 71 on the protrusion 70 contact each other to prevent the protrusion 70 leaving the channel 80.

The projections 71 are configured such that when they contact the abutment portion of the channel 80, they cannot be deformed in such a way that the protrusion 70 can leave the channel 80. For example, in the first embodiment of the connector of FIG. 17, the projections 71 are angled away from the distal end of the protrusion 70 so that when they abut the abutment portion of the channel 80, they are splayed, increasing the width of the protrusion 70. In the second and third embodiments of the connector of FIGS. 18 and 19, the back surface of the projections 71 is substantially perpendicular to the extension direction of the protrusion 70 such that abutment of the projections against the abutment portion of the channel 80 does not provide a force directed towards the slot 73 which would narrow the protrusion 70.

As shown in FIG. 17 the walls 82, 83 of the channel 80 may be provided by a bracket within the inner shell 3. The bracket may be formed from a relatively hard material compared to the inner shell 3 when a helmet 1 is constructed, the material forming the inner shell 3 may be moulded around the bracket.

FIG. 20 shows a second embodiment of a channel 80 according to the present disclosure. The second embodiment of the channel 80 is substantially the same as the first embodiment, however, additionally a spring member 84 is provided within the channel 80. The spring member 84 provides a spring force and/or damping force in a direction parallel to (e.g. opposite to) the insertion direction of the protrusion 70 into the channel 80. The spring member 83 is configured to damp or slow the movement of the protrusion 70 out of the channel 80.

In this embodiment, the spring member 84 extends into the main portion of the channel 80 from the entrance 81. A distal end **84*a* of the spring member 84 provides the abutment portion of the channel 80. As the protrusion 70 is retracted from the channel 80, the projections 71 abut the distal end 84*a* of the spring member 84 and compress the spring member 84. Thus, the reaction force of the spring member 84 opposes the movement of the protrusion 70**.

Alternatively, the spring member 84 may extend into the main portion of the channel 80 from a distal end of the channel 80. Thus, the spring force and/or damping force may be provided by the reaction force to extension of the spring member 84.

An orthogonal view of the brackets shown in FIGS. 17 and 20 is shown in FIG. 21. As shown, the bracket may comprise a first wall 82 which forms the entrance 81 to the channel 80. The first wall 82 may extend either side of the entrance 81 to the channel 80 to provide additional support to the inner shell 3. The bracket further comprises a second wall 83 forming the main portion of the channel 80, which is connected at one end to the first wall 82. The bracket may also comprise projections 85. The material forming the inner shell 3 may be moulded around these projections 85 so that the bracket is more securely held within the inner shell 3.

FIG. 22 shows an alternative example of a bracket and FIGS. 23 and 24 show a corresponding alternative example of a protrusion 70 of a connector 50. As illustrated in FIG. 22, the bracket may comprise one or more openings 86 adjacent the channel 80. At least one opening 86 may be elongate and run in the same direction as the channel 80. At least one opening 86 may be relatively short in comparison. Openings 86 may be provided on opposing sides of the channel as shown. As shown in FIGS. 23 and 24, the protrusion 70 may comprise one or more corresponding projections 71 configured to locate in the openings 86, when the protrusion 70 is within the channel 80. The projections 71 are configured to engage with the wall (part of the bracket) at the end of the corresponding opening 86 to prevent the protrusion 70 leaving the channel 80. A projections 71 may be configured to move up and down an elongate opening 86 as the protrusion 70 moves up and down the channel 81.

The allowed range of motion of the protrusion 70 within the channel 80 can be controlled by the location, size and/or shape of the opening and the location of the projection 71, for example. For example, a projection 71 at the distal end of the protrusion 70 may allow greater range of motion than a projection 71 at the proximal end of the protrusion 70.

FIG. 23 also shows an optional feature that may be applied to any of the connectors 50 disclosed herein, which is a snap-fit connection 58 on the first connection part 51 of the connector 50. As shown, the snap fit connector 58 may at least partially surround the aperture 57 in the first connection part 51. The snap-fit connection 58 may comprise a plurality of flanges (e.g. three) that fit though a corresponding hole 41 and snap around a portion of an intermediate layer 4, such as a low friction PC layer, as illustrated in FIG. 25.

Variations of the above described embodiment are possible in light of the above teachings. It is to be understood that the invention may be practised otherwise than specifically described herein without departing from the spirit and scope of the invention.

The invention claimed is:

1. A helmet, comprising:

inner and outer shells configured to slide relative to each other; and a connector connecting the inner and outer shells so as to allow the inner and the outer shells to slide relative to each other, the connector comprising:

an attachment part attached to one of the inner shell and the outer shell, wherein the attachment part comprises one or more protrusions and the inner or outer shell attached to the attachment part comprises one or more channels into which the protrusions extend;

a further attachment part attached to the other of the inner and outer shells; and one or more resilient structures extending between the attachment parts and configured to connect the attachment parts so as to allow the attachment parts to move relative to each other as the resilient structures deform, wherein:

the protrusions and channels are configured such that the protrusions can move within the channels in an extension direction of the protrusions, during sliding of the inner and outer shells relative to each other, and the protrusions comprise an abutment member configured to abut an abutment portion of the channel to prevent the protrusion leaving the channel.

2. The helmet of claim 1, wherein the abutment member comprises one or more projections extending outwardly from an elongate main portion of the protrusion, the projections being configured to abut the abutment portion of the channel to prevent the protrusion leaving the channel.

3. The helmet of claim 2, wherein the projections are angled away from a distal end of the protrusion.

4. The helmet of claim 2, wherein the abutment member is elastically deformable such that the protrusion can be inserted into the channel when the abutment member is in a deformed state and the abutment member prevents the protrusion leaving the channel when the abutment member is in an un-deformed state.

5. The helmet of claim 4, wherein the projections are configured to elastically deform by bending relative to the elongate main portion of the protrusion, wherein the elongate main portion of the protrusion is configured to elastically deform.

6. The helmet of claim 1, wherein the elongate main portion of the protrusion comprises a slot extending in the extension direction of the protrusion, the projections are provided adjacent the slot, and the elongate main portion of the protrusion is configured to deform by bending so as to narrow the slot.

7. The helmet of claim 1, wherein the channel comprises an entrance that is narrower than a main portion of the channel for accommodating the protrusion, and the abutment portion of the channel is a wall forming the entrance to the channel.

8. The helmet of claim 1, wherein the channel comprises a spring member configured to damp or slow the movement of the protrusion out of the channel.

9. The helmet of claim 1, wherein the wall of the channel is provided by a bracket provided within the inner or outer shell comprising the channel, wherein the bracket is formed from a relatively hard material relative to the inner or outer shell comprising the channel.

10. The helmet of claim 9, wherein the material forming the inner or outer shell comprising the channel is moulded around the bracket.

11. The helmet of claim 1, wherein the protrusions extends in a direction substantially parallel to an extension direction of the inner and outer shells, or substantially perpendicular to a radial direction of the helmet.

12. The helmet of claim 1, wherein the direction of the relative movement between the attachment parts is parallel to a direction of said relative sliding between the inner shell and the outer shell of the helmet.

13. The helmet of claim 1, wherein the resilient structures extend in a direction substantially parallel to an extension direction of the outer shell and inner shell, or substantially perpendicular to a radial direction of the helmet.

14. The helmet of claim 1, wherein the first attachment part and the second attachment part are configured so as to be separated in a direction perpendicular to a radial direction of the helmet, said separation being increased/decreased by the relative movement between the attachment parts.

15. The helmet of claim 1, wherein the attachment parts and the resilient structures are arranged so as to be bisected by a plane perpendicular to a radial direction of the helmet.

16. The helmet of claim 1, wherein the attachment parts are configured to move relative to each other substantially in a plane perpendicular to a radial direction of the helmet.

17. The helmet claim 1, wherein the further attachment part is arranged to at least partially surround the attachment part.

18. A connector for use in the helmet of claim 1, for connecting the inner and outer shells so as to allow the inner and outer shells to slide relative to each other, the connector comprising:

an attachment part configured to be attached to one of the inner shell and the outer shell wherein the attachment part comprises one or more protrusions, the protrusions being configured to extend into one or more channels in the inner or outer shell to which the attachment part is configured to be attached;

a further attachment part attached to the other of the inner and outer shells; and one or more resilient structures extending between the attachment parts and configured to connect the attachment parts so as to allow the attachment parts to move relative to each other as the resilient structures deform, the protrusions are configured so as to move within the channels in an extension direction of the protrusions, during sliding of the inner and outer shells relative to each other, and the protrusions comprise an abutment member configured to abut a portion of the channel to prevent the protrusion leaving the channel.

19. A bracket for use in the helmet of claim 1, to be provided within the inner or outer shell of the helmet and to provide the channel of the claimed helmet, the bracket comprising:

a channel configured such that a protrusion of the connector can extend into the channel and configured such that the protrusion can move within the channel in an extension direction of the protrusions, during sliding of the inner and outer shells relative to each other; wherein the channel comprises an abutment portion configured to abut an abutment member of the protrusion to prevent the protrusion leaving the channel.

* * * * *